US007719205B2

(12) United States Patent
Chung

(10) Patent No.: US 7,719,205 B2
(45) Date of Patent: May 18, 2010

(54) INVERTER FOR DRIVING LIGHT SOURCE

(75) Inventor: Chin-Biau Chung, Taipei Hsien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/143,447

(22) Filed: Jun. 20, 2008

(65) Prior Publication Data

US 2009/0315469 A1 Dec. 24, 2009

(51) Int. Cl.
*H05B 37/02* (2006.01)

(52) U.S. Cl. ..... 315/291; 315/225; 315/247; 315/307

(58) Field of Classification Search ..... 315/209 R, 315/224, 291, 307, 210, 211, 225, 240, 247, 315/308, 360–362; 363/43, 95, 96, 15, 16, 363/21.01, 21.1, 21.11, 40, 74, 109
See application file for complete search history.

(56) References Cited

U.S. PATENT DOCUMENTS 4,490,666 A * 12/1984 Tanamachi et al. ..... 318/800
6,600,271 B1 * 7/2003 Chen ..... 315/224
6,690,591 B2 * 2/2004 Min ..... 363/97
7,477,024 B2 * 1/2009 Lin et al. ..... 315/307

FOREIGN PATENT DOCUMENTS

TW I256862 6/2006

* cited by examiner

*Primary Examiner*—Douglas W Owens
*Assistant Examiner*—Jimmy T Vu
(74) *Attorney, Agent, or Firm*—Muncy, Geissler, Olds & Lowe, PLLC

(57) ABSTRACT

An inverter for driving light source is disclosed. The inverter includes a pulse control unit for producing a conduction period signal, a power switch unit driven by the conduction period signal and a power conversion unit for outputting a driving power, wherein a waveform modulation unit is further connected between the power switch unit and the power conversion unit, and the waveform modulation unit obtains the input power from the power switch unit and converts thereof into a modulation power, wherein the modulation power includes a positive edge modulation period with gradually rising voltage peak and a negative edge modulation period with gradually falling voltage peak, with the positive edge modulation period has a duration longer than that of the negative edge modulation period, and the modulation power is transmitted to the power conversion unit for being further converted into the driving power.

4 Claims, 4 Drawing Sheets

INVERTER FOR DRIVING LIGHT SOURCE

FIELD OF THE INVENTION

The present invention is related to an inverter for driving a light source, and more particularly to an inverter circuit which can provide a driving power to drive a lamp.

BACKGROUND OF THE INVENTION

Currently, the light source mainly includes HID (High-Density Discharge) lamp and LED (Light Emitting Diode). For increasing the efficiency in lighting, the inverter used for driving light source is improved gradually. The circuit architecture of the convention inverter is shown in FIG. 1. The piezoelectric inverter includes a filter unit 1, a pulse control unit 2, a power switch unit 3 and a power conversion unit 4. After a DC input power 91 passes through the filter unit 1, the pulse control unit 2 through controlling the conduction period of the power switch unit 3, and further controls the power conversion unit 4 to convert the period of the input power 91. Then, the power conversion unit 4 provides the driving power, and the pulse control unit 2 draws out a feedback signal from the power conversion unit 4. The power conversion unit 4 is further connected to an output coupling unit 5 for delivering energy to at least a lamp tube set 6. The circuit architecture described above purely utilizes the pulse control unit 2 to control the conduction or disconnection of the power switch unit 3, which is namely the conventional BOOST MODE technology, wherein the waveform of the power passing through the power switch unit 3 is a square wave which rises and falls steeply (as shown in FIG. 2). However, the conventional driving method is disadvantageous of damaging the inverter and the light source. Take HID lamp as an example. When operation, except the filling gas and the fluorescent powder are related to the working efficacy of HID lamp, the power provided by the inverter for driving the lamp which rises and falls steeply also might reduce the life time of the HID lamp. Moreover, in the inverter, except utilization of the traditional coil to produce electromagnetic induction, the piezoelectric blade is also used. But, the square wave of power might cause the output voltage of the piezoelectric blade to have excess undulation, so as to reduce the life time of the piezoelectric blade itself and also the loading. Therefore, the applicant previously disclosed TWP No. I256862, entitled "Method for controlling power source in modulation mode", filed in Nov. 17, 2004, for improving the drawbacks of BOOST MODE control method as described above. In this patent, modulation energy with gradually changed amplitude is inserted between the conduction (ON) and the disconnection (OFF), so that the waveform of the driving power still can have a smaller voltage amplitude during the disconnection, and thus, the voltage amplitude difference between the conduction (ON) and the disconnection (OFF) becomes smaller, thereby reducing the impact on the piezoelectric blade and the loading. However, in this patent, when driving the loading in practice, owing to the added modulation energy, the falling of the waveform becomes smaller between the conduction (ON) and the disconnection (OFF), so that the brightness decrease of the lamp tube is limited due to the conversion characteristic of the piezoelectric blade, even the brightness of the lamp tube might become non-uniform. Therefore, there is a need to improve thereof.

SUMMARY OF THE INVENTION

Owing to the drawbacks in the prior art, the object of the present invention is to provide an inverter circuit for driving HID lamp tube, in which the impact on the piezoelectric blade can be reduced, so that the brightness modulation range of the lamp tube can be enlarged and the lamp tube also can eliminate an uniform brightness.

The present invention is related to an inverter for driving light source. The inverter includes a pulse control unit for producing a conduction period signal, a power switch unit driven by the conduction period signal and a power conversion unit for outputting a driving power, wherein after the inverter obtains an input power, the input power is transmitted to the power conversion unit through the conduction period of the power switch unit. The inverter is characterized in that a waveform modulation unit is further connected between the power switch unit and the power conversion unit, and the waveform modulation unit obtains the input power from the power switch unit and converts thereof into a modulation power, wherein the modulation power includes a positive edge modulation period with gradually rising voltage peak and a negative edge modulation period with gradually falling voltage peak, with the positive edge modulation period has a duration longer than that of the negative edge modulation period, and the modulation power is transmitted to the power conversion unit for being further converted into the driving power. Therefore, through the positive edge modulation period of the modulation power, the piezoelectric blade will not produce excess surge as initiation, and through the negative edge modulation period of the modulation power, the piezoelectric blade can receive a sufficient voltage drop, so that the outputted driving power can have sufficient voltage modulation range, thereby expending the brightness modulation range of the lamp tube and solving the problem of non-uniform brightness.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
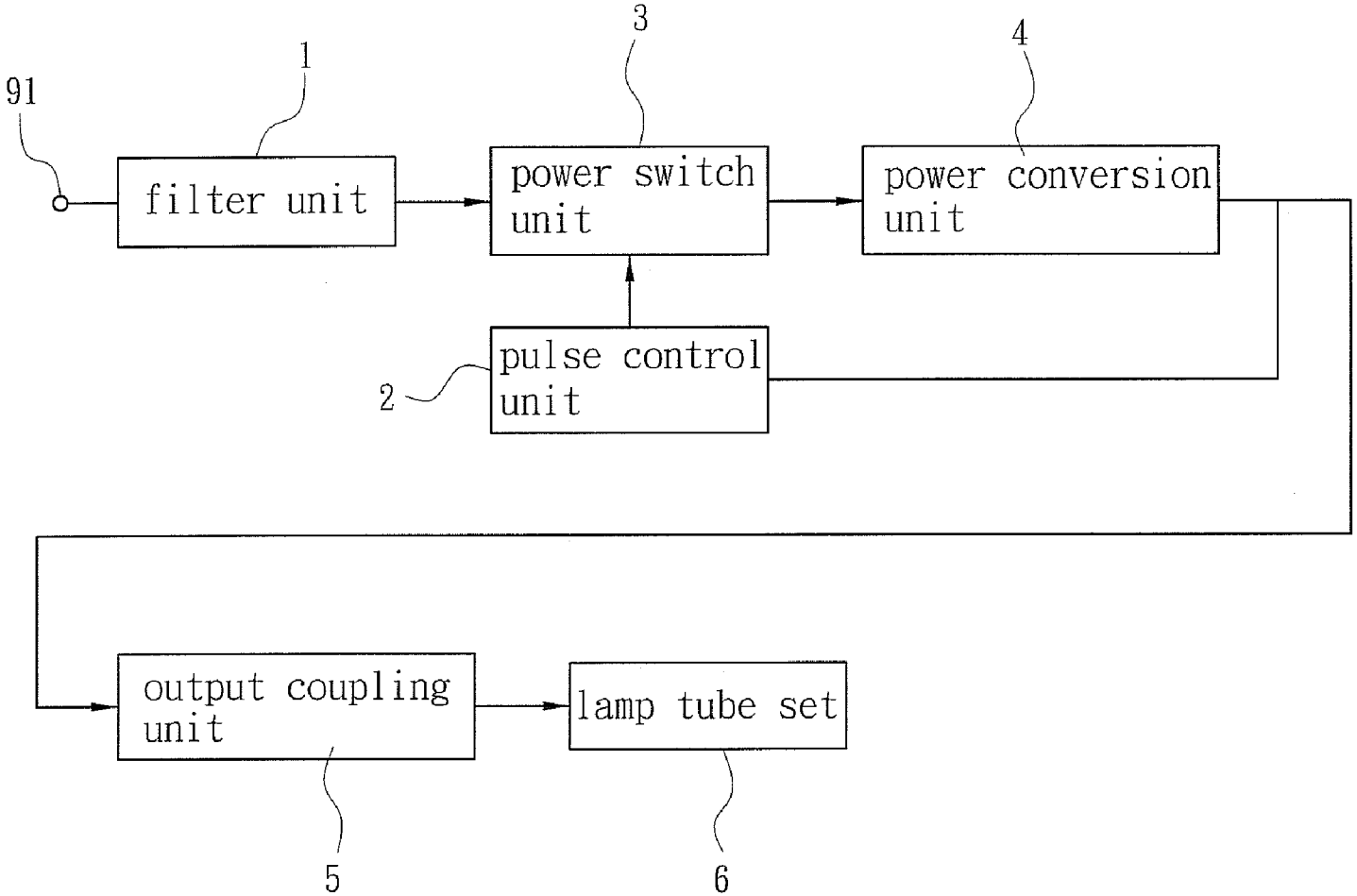
Fig. 1 PRIOR ART
FIG. 1 is a block diagram showing the architecture of the conventional inverter.
Figure 2:
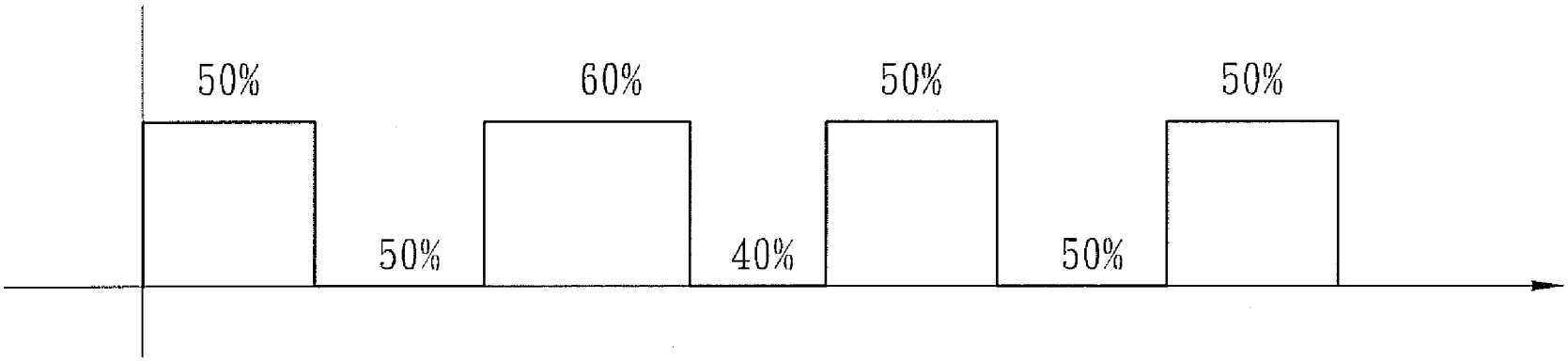
Fig. 2 PRIOR ART
FIG. 2 shows the output waveform of the conventional inverter.
Figure 3:
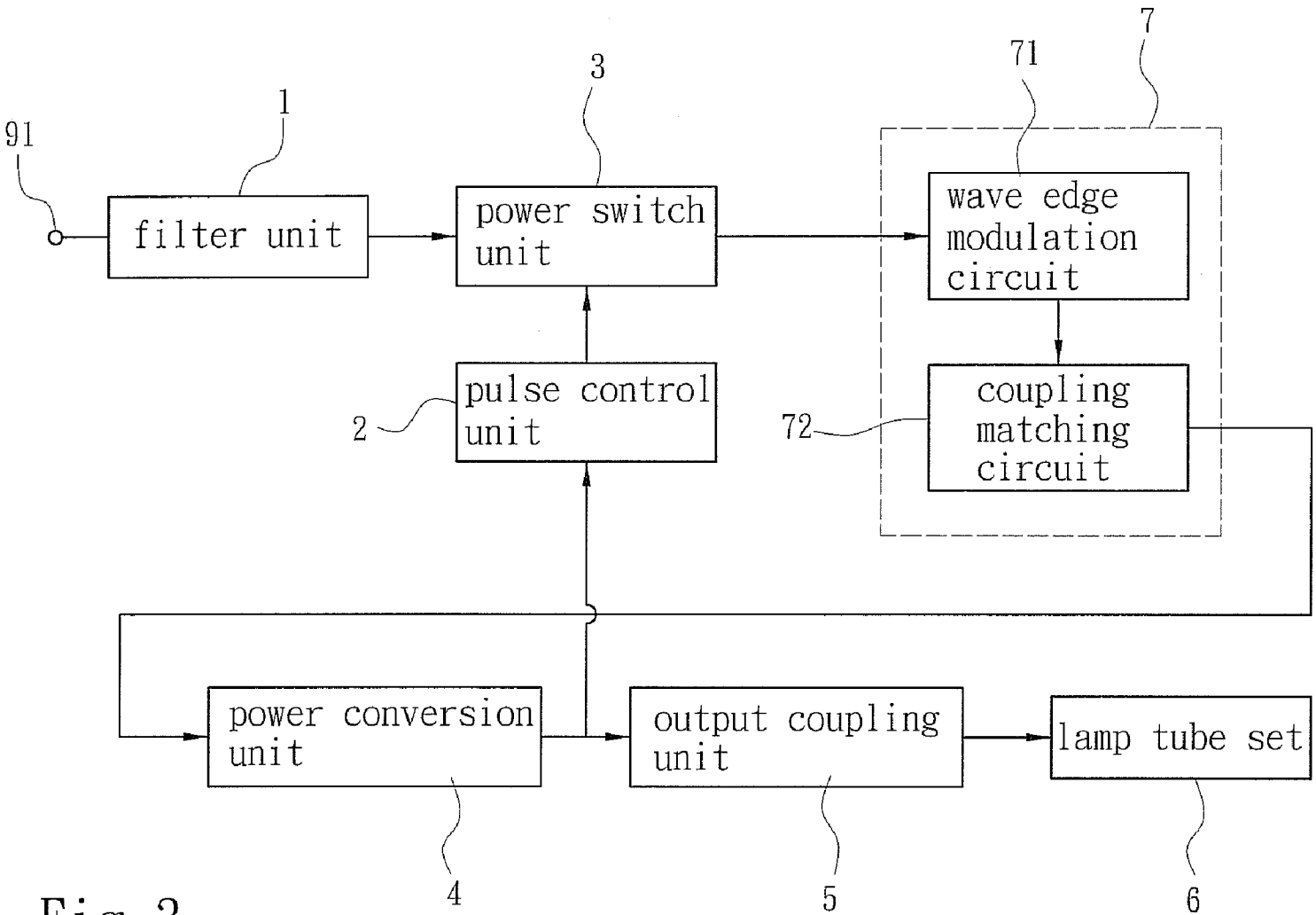
FIG. 3 is a block diagram showing the architecture of an inverter in the present invention.
Figure 4:
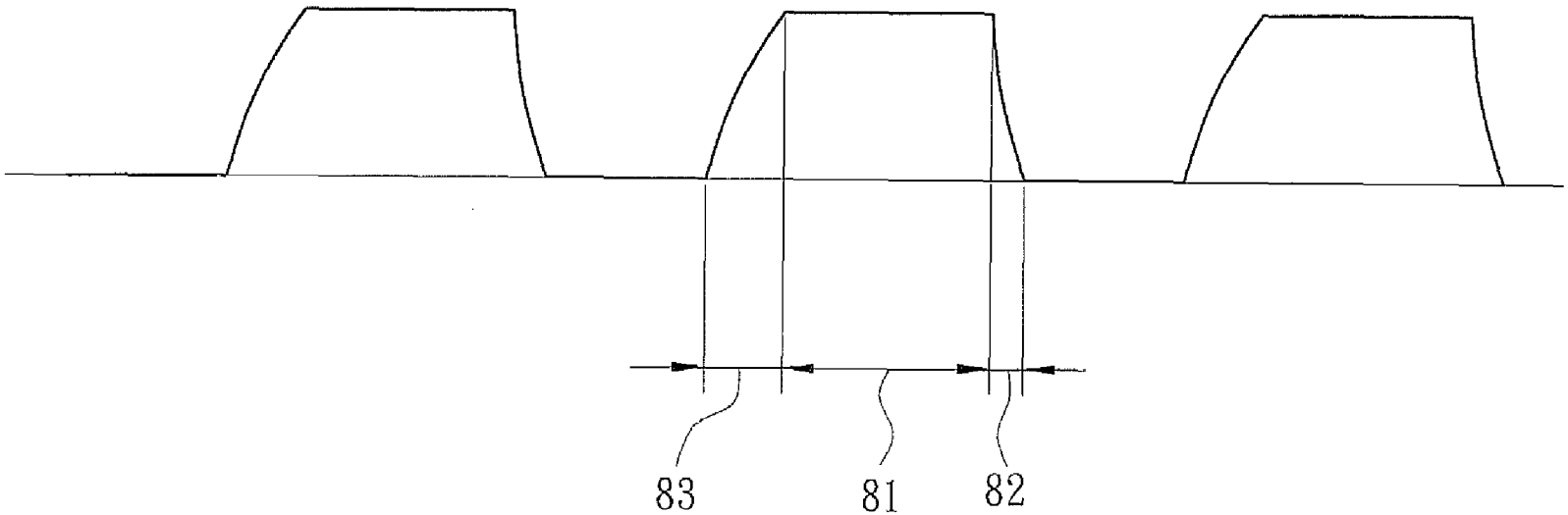
FIG. 4 shows the output waveform of the inverter in the present invention.

Please refer to FIG. 3. The present invention is related to an inverter for driving light source, wherein the inverter includes a pulse control unit 2 for producing a conduction period signal, a power switch unit 3 driven by the conduction period signal and a power conversion unit 4 for outputting a driving power. After the inverter obtains an input power 91 via a filter unit 1, the pulse control unit 2 utilizes the conduction period signal to drive the power switch unit 3, so that the input power 91 is transmitted to the power conversion unit 4 through the conduction period of the power switch unit 3. The inverter is characterized in that a waveform modulation unit 7 is further connected between the power switch unit 3 and the power conversion unit 4. Here, the waveform modulation unit 7 obtains the input power 91 from the power switch unit 3 and converts thereof into a modulation power, wherein the modulation power includes a positive edge modulation period 83 with gradually rising voltage peak (as shown in FIG. 4) and a negative edge modulation period 82 with gradually falling voltage peak (as shown in FIG. 4), and the positive edge modulation period 83 has a duration longer than that of the negative edge modulation period 82. Then, the modulation power is transmitted to the power conversion unit 4 for being further converted into the driving power, and then, the driving power is transmitted to a lamp tube set 6 by an output coupling unit 5 for lighting up thereof. Since the duration of the positive edge modulation period 83 is longer than that of the negative edge modulation period 82, the rising of the modulation power becomes more slower, and after the disconnection of the power switch unit 3, the negative edge modulation period 82 is extremely short, so that power conversion unit 4 can have a larger voltage difference. Moreover, because the modulation power has the positive edge modulation period 83 which can reduce the surge produced by the power conversion unit 4, the impacts on the power conversion unit 4, the rear end circuit elements and the lamp tube set 6 become smaller, and thus, the life time can be extended. Furthermore, after the disconnection of the power switch unit 3, the voltage drop produced by the negative edge modulation period can enlarge the range of the driving power modulated by the power conversion unit 4, so that the modulation range of the brightness of the lamp tube set 6 also can be enlarged, thereby solving the problem of non-uniform brightness. Besides, the waveform modulation unit 7 includes a wave edge modulation circuit 71 and a coupling matching circuit 72, wherein the coupling matching circuit 72 provides a time constant to the wave edge modulation circuit 71 for converting the input power 91 into the modulation power through the charge/discharge principle. Here, since the time constant of the charge/discharge of the wave edge modulation circuit is decided by the impedance of the coupling matching circuit 72, the duration of the positive edge modulation period and the negative edge modulation period can be produced. The wave edge modulation circuit 71 obtains the input power 91 during the conduction period of the power switch unit 3, so that the voltage peak rising of the wave edge modulation circuit 72 can be delayed, thereby producing the positive edge modulation period. The coupling matching circuit 72 makes the wave edge modulation circuit 71 to discharge at the disconnection period of the power switch unit 3, so that the voltage of the wave edge modulation circuit 71 can drop rapidly, thereby producing the negative edge modulation period. Through the method described above, the input power 91 can be modulated, so as to achieve the purposes of reducing surge impact and enlarging light modulation range.

Please refer to FIG. 4, which shows the waveform of the modulation power produced by the architecture described above. As shown, the modulation power includes the positive edge modulation period 83 at the front edge, the negative edge modulation period 82 at the rear edge, and a normal conduction period 81 which is located between the positive edge modulation period 83 and the negative edge modulation period 82 and has a constant ratio of the power level of the modulation power to the input power 91, wherein the voltage level of the normal conduction period 81 is decided by the input power 91. Furthermore, the conduction period signal for driving the power switch unit 3 can be fixed frequency, variable frequency, fixed period width or variable period width. Therefore, through the positive edge modulation period 83 of the modulation power, the production of excess surge can be avoided, and through the negative edge modulation period 82 of the modulation power, a sufficient voltage drop can be produced, so that the outputted driving power can have sufficient voltage modulation range, thereby expending the brightness modulation range of the lamp tube set 6 and solving the problem of non-uniform brightness.

The inverter of the present invention utilizes the piezoelectric blade to convert power and the characteristic of the piezoelectric blade is suitable for the control circuit to convert power.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inverter for driving light source, comprising:

a pulse control unit for producing a conduction period signal, a power switch unit driven by the conduction period signal and a power conversion unit for outputting a driving power, wherein after the inverter obtains an input power, the input power is transmitted to the power conversion unit through the conduction period of the power switch unit, and the inverter is characterized in that:

a waveform modulation unit is further connected between the power switch unit and the power conversion unit, and the waveform modulation unit obtains the input power from the power switch unit and converts thereof into a modulation power, wherein the modulation power includes a positive edge modulation period with gradually rising voltage peak and a negative edge modulation period with gradually falling voltage peak, with the positive edge modulation period has a duration longer than that of the negative edge modulation period, and the modulation power is transmitted to the power conversion unit for being further converted into the driving power.

2. The inverter as claimed in claim 1, wherein between the positive edge modulation period and the negative edge modulation period, a normal conduction period is further located which has a constant ratio of the power level of the modulation power to the input power.

3. An inverter for driving light source, comprising:

a pulse control unit for producing a conduction period signal, a power switch unit driven by the conduction period signal and a power conversion unit for outputting a driving power, wherein after the inverter obtains an input power, the input power is transmitted to the power conversion unit through the conduction period of the power switch unit, and the inverter is characterized in that:

a waveform modulation unit is further connected between the power switch unit and the power conversion unit, and the waveform modulation unit obtains the input power from the power switch unit and converts thereof into a modulation power, wherein the modulation power includes a positive edge modulation period with gradually rising voltage peak and a negative edge modulation period with gradually falling voltage peak, with the positive edge modulation period has a duration longer than that of the negative edge modulation period, and the modulation power is transmitted to the power conversion unit for being further converted into the driving power;

wherein the waveform modulation unit includes a wave edge modulation circuit and a coupling matching circuit, wherein the coupling matching circuit provides a time constant to the wave edge modulation circuit, and the wave edge modulation circuit obtains the input power during the conduction period of the power switch unit for producing the positive edge modulation period, and discharges at a disconnection period of the power switch unit for producing the negative edge modulation period.

4. The inverter as claimed in claim 3, wherein the time constant of the charge/discharge of the wave edge modulation circuit is decided by the impedance of the coupling matching circuit, so as to produce the duration of the positive edge modulation period and the negative edge modulation period.

* * * * *